US006003523A

United States Patent [19]

Nettlefold

[11] Patent Number: 6,003,523

[45] Date of Patent: Dec. 21, 1999

[54] SHAVING BRUSH

[76] Inventor: Jonathan Nettlefold, Orchard Cottage, Broad Lane, Bishampton Worcs., WR10 2LY, United Kingdom

[21] Appl. No.: 09/201,885

[22] Filed: Nov. 30, 1998

[30] Foreign Application Priority Data

Dec. 2, 1997 [GB] United Kingdom ..... 9725531

[51] Int. Cl.[6] ..... A45D 27/16; A45D 27/18

[52] U.S. Cl. ..... 132/290; 132/289; 132/320; 401/144; 401/190; 222/402.13; 15/105

[58] Field of Search ..... 132/290, 289, 132/320; 401/190, 144, 288, 289, 272, 282, 286; 222/402.13, 213, 523; 15/105, 111

[56] References Cited

U.S. PATENT DOCUMENTS

| | | | |
|---|---|---|---|
| 2,764,772 | 10/1956 | Staskowski et al. | 401/190 |
| 3,093,857 | 6/1963 | Hersh | 401/190 |
| 3,343,201 | 9/1967 | Cox et al. | 132/290 |
| 3,387,911 | 6/1968 | Focht | 401/190 |
| 3,388,958 | 6/1968 | Modla | 132/290 |
| 3,495,922 | 2/1970 | Steinman | 132/290 |
| 3,653,090 | 4/1972 | Weaver | 132/290 |
| 4,252,455 | 2/1981 | De La Pena | 401/190 |
| 4,603,992 | 8/1986 | Kavoussi | 401/190 |
| 5,692,846 | 12/1997 | Schwarzberg | 401/190 |

*Primary Examiner*—Gene Mancene
*Assistant Examiner*—Pedro Philogene

[57] ABSTRACT

A shaving brush comprises a body member having an upper end and a base, a brush head comprising natural or synthetic bristle being attached to said upper end, the body member including a delivery channel extending therethrough from said base to said head for shaving product dispensed in use from an aerosol container having an outlet valve, the brush including a removable adapter member which is locatable in use on said outlet valve.

13 Claims, 1 Drawing Sheet

Figure 1:
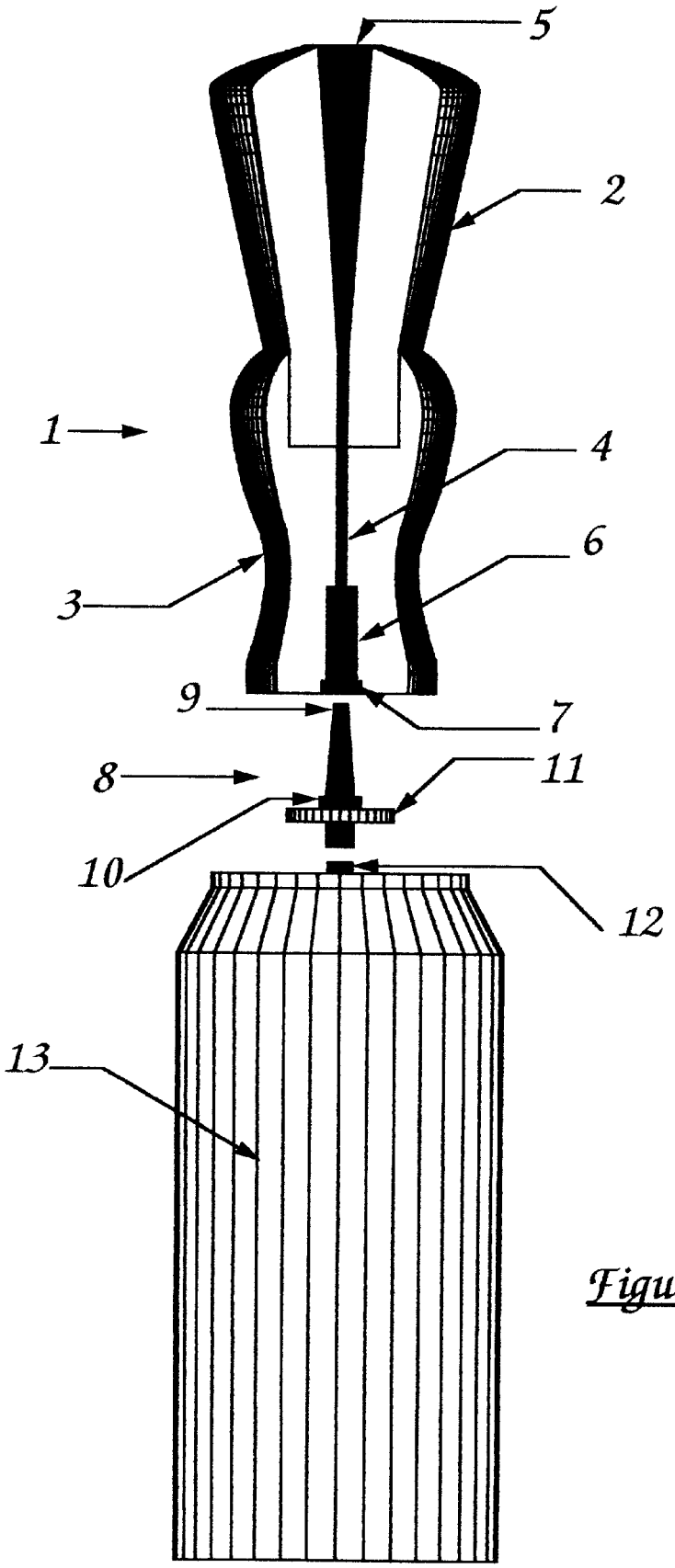

SHAVING BRUSH a. CROSS REFERENCE TO RELATED APPLICATIONS WO-A-84/04658 b. STATEMENT REGARDING FEDERALLY SPONSORED RESEARCH OR DEVELOPMENT

Not Applicable c. REFERENCE TO MICROFICHE APPENDIX

Not Applicable d. BACKGROUND OF THE INVENTION

The present invention relates to a shaving brush

Shaving brushes are well known utensils for applying soap to body hair for the purpose of shaving.

Shaving brushes have become rather unfashionable over the years, and now the largest portion of the market for shaving foam and gels are applied by hand from pressurised cans. This means that the superior skin care qualities of these foams and gels are denied to the traditional users of brush and soap Certain improvements have been made to shaving brushes in an attempt to resolve this problem. However these improvements have tended either to be less attractive in look and feel than a traditional shaving brush or, for example, as with WO-A-84/04658, where the entrance of a bore in the handle is shaped to co-operate directly with the valve of an aerosol, locating the bore in the brush handle with the valve is relatively difficult because of the small diameters involved.

It is the object of the present invention, therefore, to provide a means of loading the head of the shaving brush with foams and gels from a pressurised can in a way which is both simple and clean for the user to operate.

e. BRIEF SUMMARY OF THE INVENTION

According to the present invention there is provided a shaving brush comprising a body member having a brush head comprising natural or synthetic bristle attached to the upper end thereof, the body member including a delivery channel extending therethrough for shaving product dispensed from an aerosol container, in which the brush includes a removable adapter member which is locatable in use on the outlet tube of the aerosol container.

Preferably, the adapter member has a straight bore whereby shaving product is passed in the director of ejection, co-axially of the outlet tube, through the delivery channel to the brush head. The bristles may also define an aperture in alignment with the delivery channel to provide unimpeded access of shaving product to the tips of the bristles and to prevent any back pressure in the delivery channel or adapter member.

The adapter member has a discharge part which preferably includes a nozzle which is locatable in the lower end of the delivery channel. In order to locate the adapter more easily in the delivery channel, at least the distal end region of the nozzle may be tapered. Preferably, the lower end region of the delivery channel which in use receives the nozzle has an enlarged diameter. To provide for accurate positioning of the nozzle within the delivery channel, the proximal end of the nozzle may comprise a radially enlarged boss which is received in a correspondingly-sized counter bore formed in the base of the body member of the brush; the adapter member also preferably includes an annular flange below the boss, to bear against the base of the body member in use and also to enable the adapter member more easily to be applied by hand to the outlet tube of the aerosol container.

The brush body member may be formed from a solid material, in which case the delivery channel may be formed directly therein as a bore extending from the base to the head. If the body member is hollow, the delivery channel may comprise a tube which may be separately inserted or, if the brush body member is moulded in two halves, may be integrally formed as two channel sections each in a respective half and which may be glued, welded or otherwise secured together to form, the complete delivery channel internally of the body member.

f. BRIEF DESCRIPTION OF THE DRAWING

FIG. 1 —is an exploded diagram showing a cutaway section of a shaving brush, an adapter member according to a preferred embodiment, and an aerosol can.

g. DETAILED DESCRIPTION OF THE INVENTION

Referring to FIG. 1, the handle 3 of a traditional shaving brush (generally indicated by 1) has a bore 4 extending through the handle 3 from its base into the center of the bristles 2. The bristles are formed with a central aperture 5 co-axial with the bore 4. The lower part of the bore is enlarged at 6 and further enlarged in the base with a larger-diameter counter-bore 7.

An adapter 8 has a tapered spout or nozzle 9, a boss 10 and a flange 11; the adapter is suitable for fitting to the outlet valve 12 of an aerosol can 13, once the conventional nozzle has been removed. The boss 10 is receivable in counter-bore 7 and the tip of the nozzle 9 is receivable in the entrance to the central aperture 5, at the upper end of enlarged part 6.

In use, the adapter 8 is applied to the outlet tube of the aerosol can and the nozzle 9 is inserted into the entrance 7 of the bore 4. By pressing down on the shaving brush while the can is on a suitable surface such as a table top, the foam is delivered under pressure through the bore into the bristles 2. When the required dose has been delivered, the shaving brush is removed from the adapter and the shaving foam is applied to the pre-wetted surface of the skin with the brush, in the usual manner. The adapter may be provided with a removable cap to prevent foam in the nozzle from drying out, whereby the adapter can be left in place on the aerosol can for as long as the can contains shaving product.

What is claimed is:

1. A shaving brush comprising a body member having an upper end and a base, a brush head comprising bristle selected from the group consisting of natural and synthetic bristle being attached to said upper end, said body member including a delivery channel extending therethrough from said base to said head to receive therein shaving product dispensed from an aerosol container having an outlet valve, the brush including an adapter member, said adapter member being removably insertable in the body member of said brush and locatable on said outlet valve of said aerosol container.

2. A shaving brush according to claim 1, wherein the adapter member has a straight bore.

3. A shaving brush according to claim 1, wherein the adapter member includes a nozzle which is locatable in the lower end of the delivery channel.

4. A shaving brush according to claim 3, wherein the nozzle has a distal end region which is tapered.

5. A shaving brush according to claim 3, wherein the nozzle has a proximal end which comprises a radially-enlarged boss for cooperation with the base of the brush.

6. A shaving brush according to claim 5, wherein the proximal end of the nozzle further comprises an annular flange extending below said boss for cooperation with the base of the brush.

7. A shaving brush comprising a body member having an upper end and a base, a brush head comprising bristle selected from the group consisting of natural and synthetic bristle being attached to said upper end, said body member having a delivery channel extending therethrough from said head to said base to receive therein shaving product dispensed from an aerosol container having an outlet valve, said delivery channel opening directly in said base of said brush and being formed at said opening with an enlarged diameter to removably receive the discharge part of an adapter member locatable on said outlet valve of said aerosol container.

8. A shaving brush according to claim 7, in which the base of the body member is formed with a radially-enlarged counterbore coaxial with saidelivery channel.

9. A shaving brush according to claim 7, wherein the bristles define an aperture in alignment with said delivery channel.

10. A shaving brush according to claim 7, wherein the brush body member is formed from a solid material, and the delivery channel is formed directly therein as a bore extending from the base to the head.

11. A shaving brush according to claim 7, wherein the body member is hollow and the delivery channel comprises a cylindrical tube which is separately inserted internally of the body member.

12. An aerosol can containing shaving product and having an outlet valve, wherein an adapter member is attached to said outlet valve, said adapter member being suitable for cooperating with the lower end of the delivery channel of a shaving brush according to claims 7.

13. A shaving brush according to claim 7, wherein the body member is hollow and the delivery channel comprises a cylindrical tube which is integrally formed as two channel sections each in a respective body member half which are secured together to form the complete delivery channel internally of the body member.

* * * * *